US005302090A

United States Patent [19]

Schoo

[11] Patent Number: 5,302,090

[45] Date of Patent: Apr. 12, 1994

[54] METHOD AND APPARATUS FOR THE UTILIZATION OF THE ENERGY STORED IN A GAS PIPELINE

[76] Inventor: Raul A. I. Schoo, French Street No 2952, Piso 10 DPTO, 1425 Buenos Aires, Argentina

[21] Appl. No.: 986,106

[22] Filed: Dec. 4, 1992

[30] Foreign Application Priority Data

Dec. 5, 1991 [AR] Argentina ..... 321324

[51] Int. Cl.[5] ..... F04B 17/00; F04B 35/00

[52] U.S. Cl. ..... 417/379; 417/399; 417/400; 417/404

[58] Field of Search ..... 417/379, 398, 399, 400, 417/401, 402, 403, 404

[56] References Cited

U.S. PATENT DOCUMENTS

| | | | |
|---|---|---|---|
| 4,353,683 | 10/1982 | Clark | 417/379 |
| 4,406,598 | 9/1983 | Walling | 417/404 |
| 4,762,473 | 8/1988 | Tieben | 417/399 |
| 5,110,267 | 5/1992 | Giordani | 417/404 |

*Primary Examiner*—Richard A. Bertsch
*Assistant Examiner*—Alfred Basichas
*Attorney, Agent, or Firm*—Lackenbach Siegel Marzullo Aronson and Greenspan

[57] ABSTRACT

A method for supplying at different pressures natural gas from a gas field under control of a continuous gas flow and the field pressure thereof and an apparatus for carrying out the method. The gas flow is received directly in and contained in two separate volumes constructed as a first variable volume and a second variable volume which are each cyclically varied in size synchronously by alternately increasing and decreasing the size of a corresponding volume under control of the gas flow. The increasing of the first volume effects a pressure reduction of the gas received therein for delivery to a distribution network at a reduced pressure. Reducing the size of the first volume discharges the gas at the reduced pressure and the cyclical varying of size alternately reducing and increasing thereof of the second volume under control of the gas flow effects increasing of the gas pressure to a desired higher pressure. The two volume are constructed as a coupled motor and compressor each of which is a cylinder and a piston reciprocal therein synchronously under the control of the gas flow and its pressure.

11 Claims, 4 Drawing Sheets

METHOD AND APPARATUS FOR THE UTILIZATION OF THE ENERGY STORED IN A GAS PIPELINE

SUMMARY OF THE INVENTION

The present invention relates to a method for supplying at different pressures natural gas from a field under control of a continuous gas flow and the field pressure thereof; and to an apparatus for carrying out such method.

More particularly, the gas flow is received directly in and contained in two separate volumes fabricated as first and second variable volumes which are each cyclically varied in size synchronously by alternately increasing and decreasing the size of a corresponding volume under control of the gas flow. Increasing of the first volume effects a pressure reduction of the gas received therein for delivery to a distribution network at a reduced pressure. Reduction in size of the first volume discharges the gas at the reduced pressure and the cyclical varying of size alternately reducing and increasing thereof of the second volume under control of the gas flow effects increasing of the gas pressure to a desired higher pressure. The two volumes are constructed as a coupled motor and compressor each which is a cylinder and reciprocating piston synchronously under the control of the gas flow and its pressure.

DESCRIPTION OF THE PREFERRED EMBODIMENTS

Figure 1:
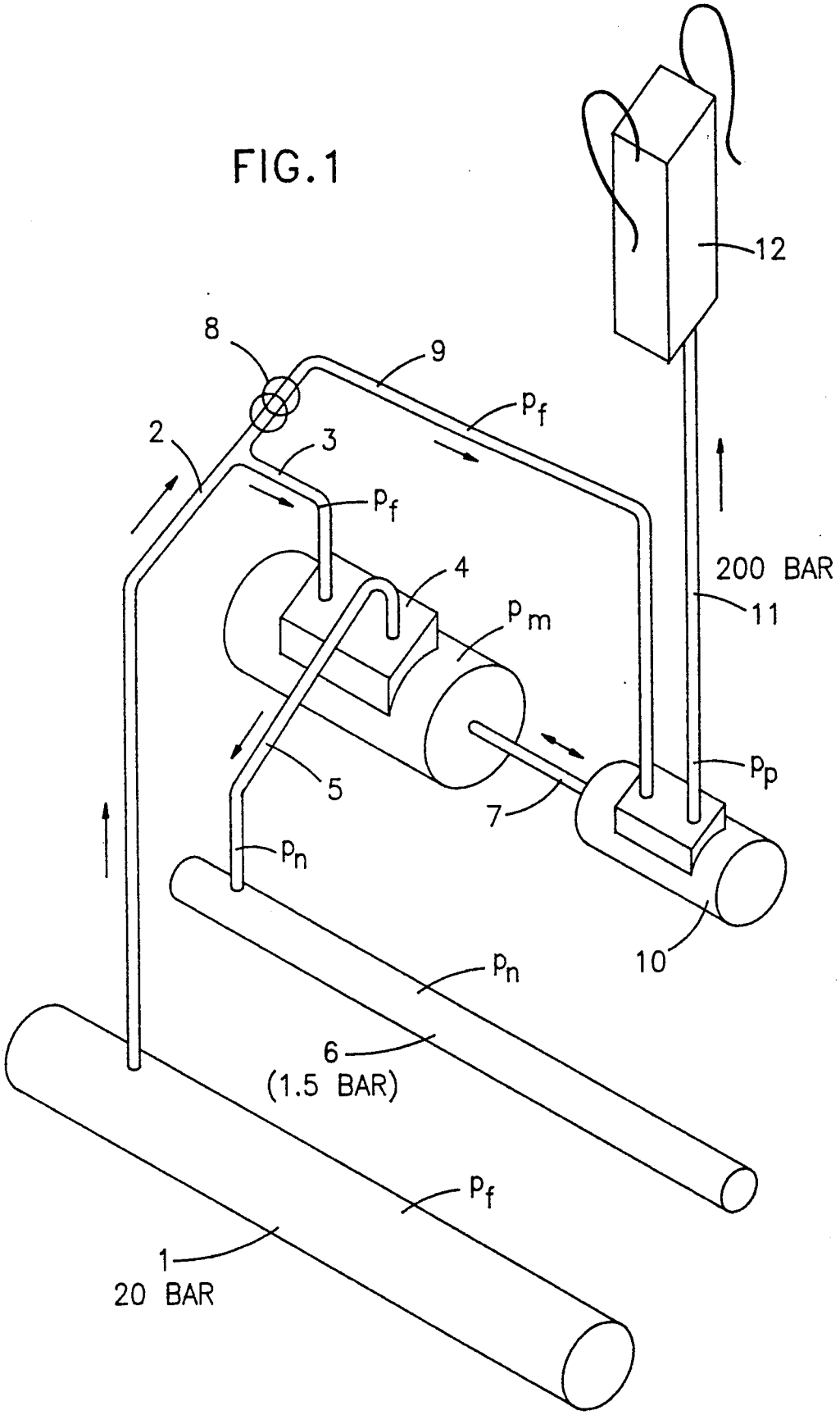
FIG. 1 is a flow diagram of present invention from the gas field to a gas filling station.
Figure 2:
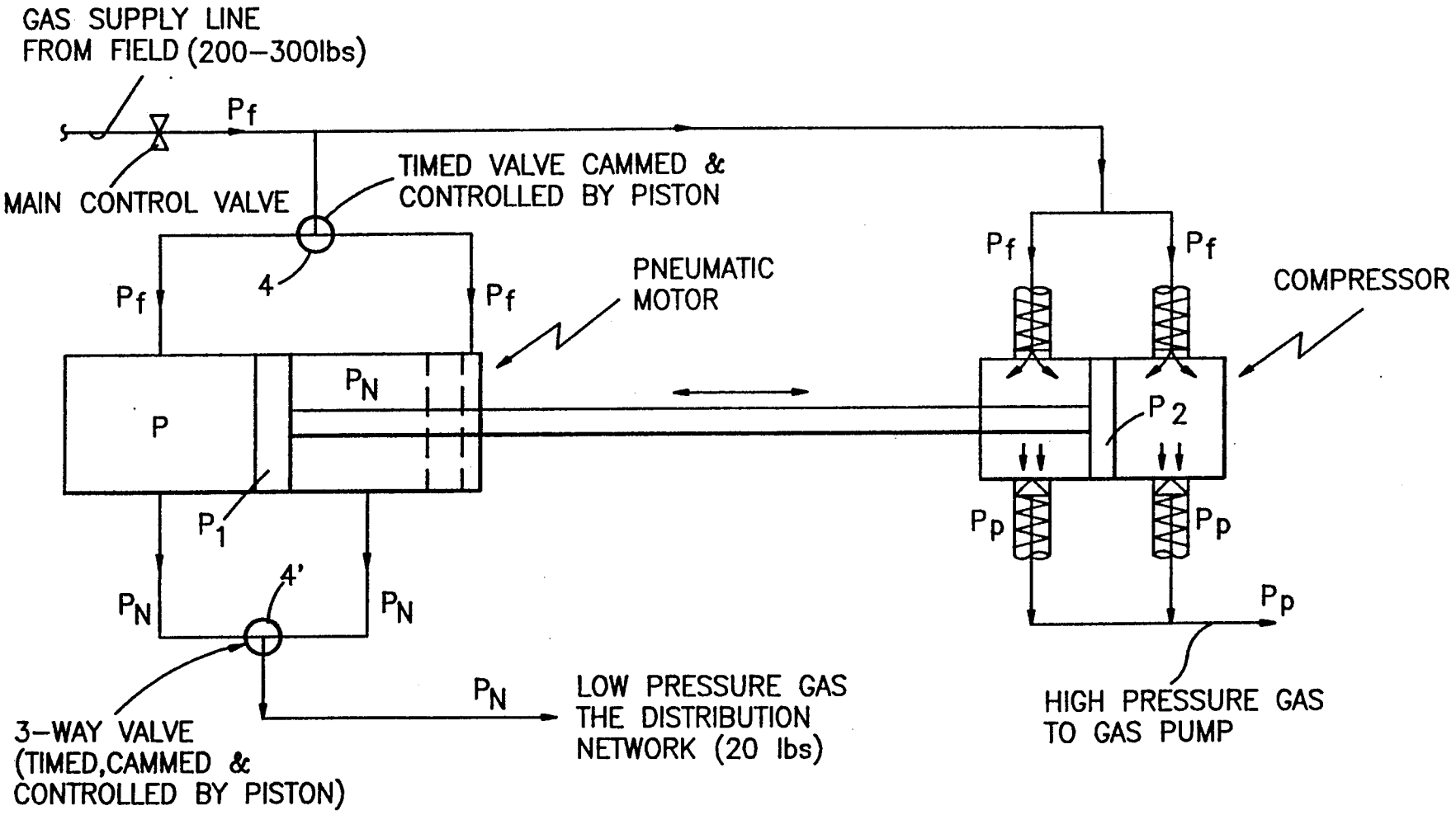
FIG. 2 is a schematic illustration of the apparatus of the invention, particularly the coupled motor and compressor and the piping to and therefrom.

Referring now to FIGS. 1–2, there is shown the apparatus of the invention. The gas flow from the field enters the apparatus via pipelines 1–2 and 3–9 and is controlled by a main "shut-off" control valve (not shown) and meter 8 is used to measure same. Gas enters simultaneously both the pneumatic motor Pm and compressor 10 which are directly connected by a common piston rod 7 extending between the motor's piston $P_1$ and the compressor's piston $P_2$.

Gas flow into the pneumatic motor is suitably valve at 4 in a timed manner to alternately enter either side of the motor's cylinder in which the motor's piston $P_1$ is slidably mounted. The gas $P_n$ leaving either side of the motor's cylinder enters via another like three-way valve 4', similarly controlled in a timed manner like the aforesaid valve, a typical low pressure gas $P_n$ distribution network via pipelines 5 and 6.

Gas flow $P_f$ into the compressor 10 is suitably valved to alternately enter both sides of the compressor's cylinder in which the compressor's piston $P_2$ is slidably mounted. The gas $P_1$ leaving either side of the compressor's cylinder enters via another set of valves the high pressure gas line ($P_p$) which shown in FIG. 1*a* as pipeline 11 is used to feed gas pumps 12, gas storage cylinders or other like means.

Thus, field gas pressure ($P_f$) enters all sides of both the motor's-compressor's cylinders; with the discharge sides of the motor producing a low pressure gas ($P_n$) for distribution to a gas network. Accordingly, $P_f > P_n$ and $P_f < P_p$ and the pipeline gas can run as high as 60 Bar with the Domestic Network having a low gas pressure of about 1.5 Bar.

Figure 3:
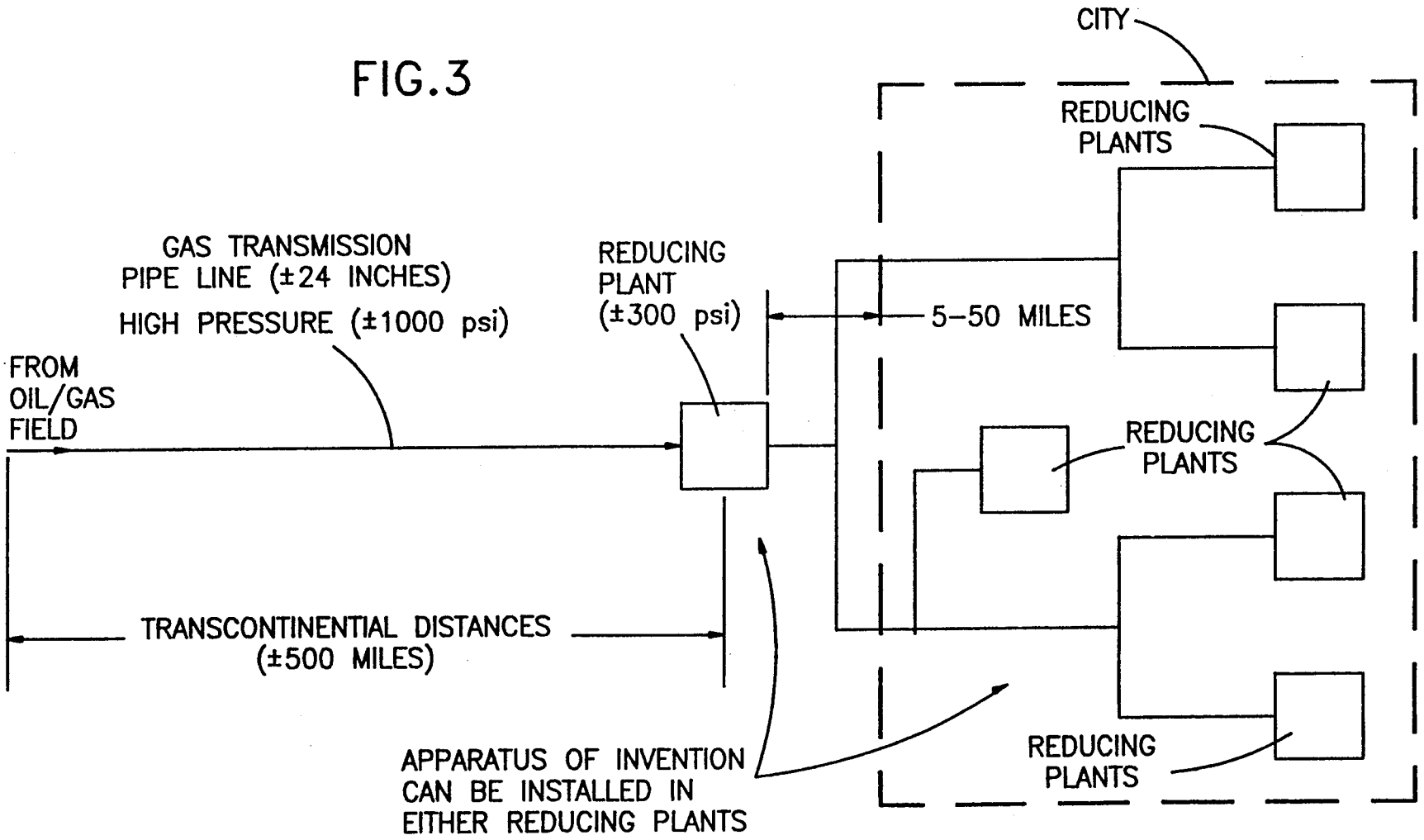
FIG. 3 is a diagrammatic view of the gas pipeline from the field to a typical domestic urban network.
Figure 5:
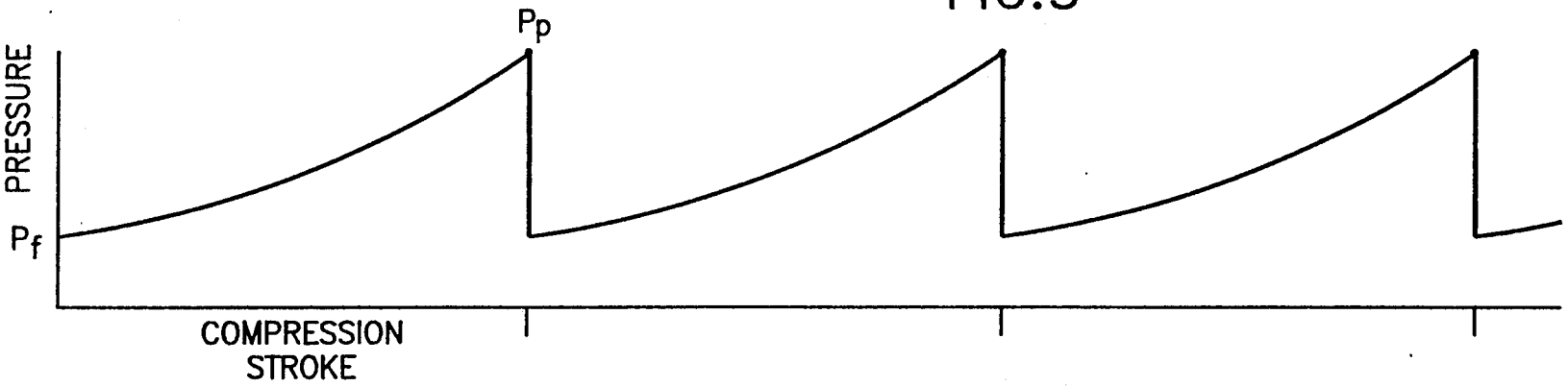
FIGS. 4 and 5 are graphs representing pressure versus the strokes of the motor and compressor, respectively, with the abscissa of the graphs showing gas expansion and compression.
Figure 4:
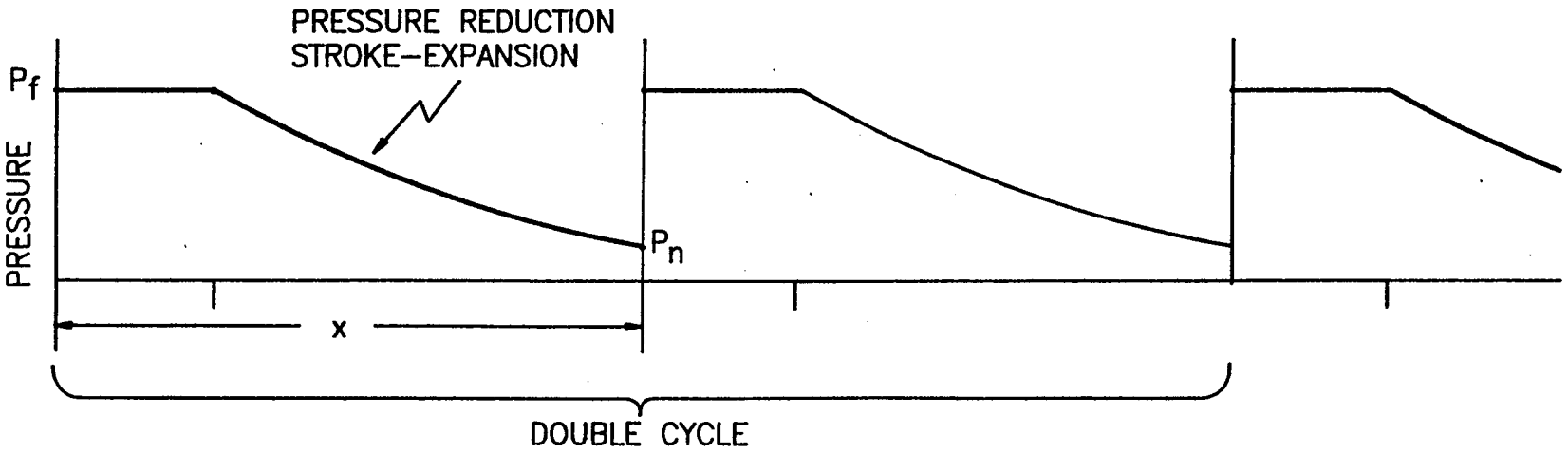

In FIG. 3 which represents diagrammatically the gas pipeline from the oil/gas field to the urban distribution network. As shown therein, a long gas transmission pipe line carries the gas transcontinental distances to a reducing plant where the gas is reduced to a psi of about 300. Thereafter, the gas is piped into the city network of pipes, with periodic reducing plants further scattered about the city network. The distance the reducing plant is to the city network is generally of the order of a few miles, and the apparatus of the invention may be employed in the reducing plant at the end of the transmission pipeline or in the reducing plants located all about the city network.

Graphs 4 and 5 illustrate, respectively, the continuous and repetitive cycles of both the expansion stroke of the motor as well as the compression stroke of the compressor.

Field pressure, for example, in Argentina can range anywhere from about 200 to 300 lbs; whereas the distribution network has a range of about 15 to 60. In Argentina, the distribution network ranges from about 15 lbs. to about 21 lbs. and the high pressure gas is in the order of about 3,555 lbs.

The apparatus in operation is such that the piston never stops at "absolute" dead center, so that one side of the motor will always be driving, and both three-way valves are suitably timed controlled by suitable means, such as camming relative to the stroke of the piston so that cyclically the size of the first volume is varied under control of the gas flow by alternatively increasing the size thereof to reduce the pressure received in the cylinder, and decreasing the cylinder size thereof to discharge the gas therein at a reduced pressure below the level of the pressure at which the gas is received from the natural gas field. Simultaneously therewith, the size of the second volume is cyclically varied by alternatively decreasing the size thereof to discharge gas contained in the cylinder at a higher pressure than the gas field pressure at which the gas is received; and after discharging the gas increasing the size of the second volume under control of the gas flow to receive gas from said gas flow for holding it therein temporarily for discharge at said increased pressure.

It should also be recognized that the apparatus of the invention is temperature compensated in that although heat is generated on compression of the gas in the compressor, during expansion the cooling effect can be used to bring down the temperature of the apparatus so that the overall device remains essentially neutral in temperature due to a compensating heating-cooling cycle which the machine is subject to during operation on a continuous basis.

In addition, it should be apparent to those skilled in the art that the machine starts when the main control valve is opened and the difference in cylinder areas generates a force differential sufficient to enable the apparatus to "turn over". Also, note that lbs. and psi are used herein and mean the same thing.

It should also be noted that the apparatus of the invention can be designed to supply any reasonable number of pumps or gas stations. In general, each arrangement is capable of supplying a small number of gas stations or pumps so that in a large network numerous systems would be placed so that the entire region is more than adequately covered.

Those skilled in the art will understand that the apparatus according to the invention is extremely simple in its construction. The working parts are two cylinders defining two separate variable volumes within which respective coupled pistons are reciprocable synchronously. The motor piston is driven by the natural gas input so that the coupled pistons vary the two volumes within which the gas is received and contained so that the pressure reduction and desired pressure increase are obtained under control of the input gas itself.

The energy for both pressure decrease by the motor and the desired pressure increase by the compressor, of the gas supplied from the natural gas field at the field pressure, is provided by the input gas itself. The valves of the system are pressure-actuated by the gas itself. The system thus is extremely energy efficient. None of the gas received from the natural gas field is consumed in operation of the system. All the gas received by the apparatus is supplied to the desired end use. The economic efficiency is maximized.

The absence of electric motor drives and avoidance of the use of internal combustion engines renders the system safe in its natural gas environment.

Although the present invention has been described in some detail by way of illustration and example for purposes of clarity and understanding, it will, of course, be understood that various changes and modifications may be made with the form, details, and arrangements of the parts without departing from the scope of the invention as set forth in the following claims.

What I claim is:

1. Apparatus for supplying natural gas from a natural gas field both at a low pressure and at a high pressure, under the control of the natural gas field pressure comprising;

a pneumatic motor receptive of natural gas under pressure from a gas field as a sole source of energy for driving said pneumatic motor;

the pneumatic motor having pressure-reducing means driven by the natural gas received under pressure for reducing the natural gas pressure received for supply to a distribution network at a reduced pressure;

a compressor driven by the pneumatic motor and receiving natural gas under pressure from the natural gas field;

the compressor having pressure-increasing means respective of the natural gas under pressure and driven cyclically by said pressure-reducing means and natural gas received therein for effectively compressing the natural gas received to a desired higher pressure;

means to deliver the natural gas from said compressor at said desired higher pressure; and means for supplying the natural gas at the reduced pressure from said pneumatic motor to said distribution network.

2. Apparatus according to claim 1, in which said pressure-reducing means comprises a cylinder and a piston cyclically driven reciprocally therein.

3. Apparatus according to claim 1, in which said compressor comprises a cylinder and a piston reciprocally driven therein.

4. Apparatus according to claim 1, in which said pressure-reducing means comprises a cylinder and a piston reciprocally driven cyclically therein by the pneumatic motor and the natural gas received therein.

5. Apparatus according to claim 4, in which said pressure-reducing means comprises a cylinder and a piston reciprocally driven therein, and means for coupling said piston in said pneumatic motor with a piston of said compressor.

6. Apparatus according to claim 1, including valve means for synchronous delivery of the natural gas to said pneumatic motor and said compressor.

7. Apparatus according to claim 1, including means for supplying natural gas under pressure from said gas field to said apparatus as a continuous natural gas flow for operating the apparatus continuously to deliver the natural gas at said reduced pressure and said desired higher pressure continuously.

8. Apparatus according to claim 1, in which said means to deliver the natural gas from said compressor at said desired higher pressure comprises means for filling vehicle natural gas fuel receptacles, natural gas storage cylinders and receptacles.

9. Apparatus according to claim 8, in which said means for filling vehicle natural gas fuel cylinders comprises natural gas pumps for fueling the vehicles.

10. A method for supplying at different pressures natural gas from a natural gas field under the control of the natural gas and the field pressure thereof comprising;

receiving from said gas field a continuous flow of natural gas under pressure and containing the natural gas flow received in two separate volume comprising a first variable volume and a second variable volume;

varying cyclically the size of the first volume under control of the natural gas flow received by alternately increasing the size thereof to reduce the pressure of natural gas received therein and decreasing the size thereof to discharge the natural gas therein at a pressure reduced below the level of the pressure at which the natural gas is received from said natural gas field;

while cyclically varying the size of the first volume, synchronously therewith cyclically varying the size of said second volume of alternately decreasing the size thereof to discharge natural gas contained therein at a desired higher pressure than the natural gas field pressure at which the natural gas is received; and after discharging the natural gas increasing the size of said second volume under control of the natural gas flow to receive natural gas from said natural gas flow for holding it therein temporarily for discharge therefrom at said increased pressure.

11. A method according to claim 10, in which natural gas flow is received into said two separate volumes from said natural gas field without varying of the natural gas field pressure.

* * * * *